US007284752B2

(12) United States Patent
Nagata et al.

(10) Patent No.: US 7,284,752 B2
(45) Date of Patent: Oct. 23, 2007

(54) JAM DISPOSER FOR SHEET POST-PROCESSING DEVICE

(75) Inventors: Jinichi Nagata, Osaka (JP); Shigeki Hayashi, Nara (JP); Kiyoshi Tokishige, Kyoto (JP); Toshiki Ogita, Nara (JP); Toyoaki Nanba, Higashiosaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/969,554

(22) Filed: Oct. 20, 2004

(65) Prior Publication Data

US 2005/0051941 A1 Mar. 10, 2005

Related U.S. Application Data

(62) Division of application No. 10/014,715, filed on Dec. 11, 2001, now Pat. No. 6,824,128.

(30) Foreign Application Priority Data

Dec. 18, 2000 (JP) ..... 2000-384256

(51) Int. Cl.
*B65H 37/04* (2006.01)

(52) U.S. Cl. ..... 270/58.18; 270/58.08; 270/58.14; 270/58.11; 270/58.13; 270/58.12; 399/410; 271/189; 271/190; 271/191; 271/192

(58) Field of Classification Search ..... 270/58.08, 270/58.09, 58.1, 58.11, 58.12, 58.13, 58.14, 270/58.15, 58.16, 58.17, 58.18; 399/110, 399/124, 125, 407, 408, 410; 271/189, 190, 271/191, 192

See application file for complete search history.

(56) References Cited

U.S. PATENT DOCUMENTS 4,734,748 A * 3/1988 Murayama et al. ..... 399/124

(Continued)

FOREIGN PATENT DOCUMENTS

JP 57-156935 9/1982

(Continued)

OTHER PUBLICATIONS

Japanese Office Action for corresponding Application No. 2000-384256 mailed Feb. 22, 2005.

(Continued)

*Primary Examiner*—Gene O. Crawford
*Assistant Examiner*—Leslie A. Nicholson, III
(74) *Attorney, Agent, or Firm*—Renner, Otto, Boisselle & Sklar, LLP

(57) ABSTRACT

A sheet post-processing device of the present invention includes a jam-disposal mechanism for moving a moving section which is provided opposite to a staple tray to the outside of the device. That is, in the sheet post-processing device, since a portion of the moving section can be moved to the outside, it is possible to form a space in front of the staple tray. Thus, it is easy to perform the jam-disposal by using the space. Further, since the staple tray is not moved in forming the space, consistency of placed sheets is not lost. Further, since it is not required that a space to perform the jam-disposal is prepared inside the device in advance, it is easy to miniaturize the device. Thus, the sheet post-processing device of the present invention is a compact sheet post-processing device by which the jam-disposal can be performed without losing the consistency of a sheet bundle placed on the staple tray.

12 Claims, 9 Drawing Sheets

U.S. PATENT DOCUMENTS

| | | | | |
|---|---|---|---|---|
| 5,169,133 | A | 12/1992 | Iwata et al. | |
| 5,573,233 | A | 11/1996 | Hirai et al. | |
| 5,895,036 | A | 4/1999 | Asao | |
| 5,971,384 | A | 10/1999 | Asao | |
| 5,995,773 | A * | 11/1999 | Awano | 399/21 |
| 6,000,894 | A * | 12/1999 | Suzuki et al. | 412/11 |
| 6,142,469 | A * | 11/2000 | Nanba et al. | 271/288 |
| 6,260,837 | B1 * | 7/2001 | Nanba et al. | 270/58.08 |
| 6,406,013 | B1 | 6/2002 | Nanba et al. | |
| 6,457,705 | B2 | 10/2002 | Nanba et al. | |
| 6,527,269 | B2 | 3/2003 | Yamada et al. | |
| 6,575,446 | B2 | 6/2003 | Wakabayashi et al. | |
| 6,824,128 | B2 * | 11/2004 | Nagata et al. | 270/58.08 |

FOREIGN PATENT DOCUMENTS

| | | | |
|---|---|---|---|
| JP | 61-072569 | | 4/1986 |
| JP | 07-137478 | | 5/1995 |
| JP | 10-129920 | | 5/1998 |
| JP | 10-177282 | | 6/1998 |
| JP | 11049421 | A | 2/1999 |
| JP | 11143257 | A | 5/1999 |
| JP | 11-147661 | | 6/1999 |
| JP | 11305628 | A | 11/1999 |
| JP | 2001-130827 | A | 5/2001 |
| JP | 2001-171901 | A | 6/2001 |
| JP | 2002-128382 | A | 5/2002 |

OTHER PUBLICATIONS

European Office Action for corresponding Application No. 01310377.5 mailed Mar. 23, 2005.

* cited by examiner

JAM DISPOSER FOR SHEET POST-PROCESSING DEVICE

This application is a divisional of U.S. patent application Ser. No. 10/014,715 filed on Dec. 11, 2001, now U.S. Pat. No. 6,824,128 which is hereby incorporated herein by reference in its entirety.

FIELD OF THE INVENTION

The present invention relates to a sheet post-processing device for performing a post process such as a stapling process and a punching process with respect to a sheet of paper supplied from an image forming device such as a copying machine.

BACKGROUND OF THE INVENTION

A recent copying machine is designed to be used in combination with an automatic document transporting device and a sheet post-processing device for realizing automation of a copying operation, and automation of a post process performed with respect to copied sheets.

Here, the sheet post-processing device is to perform a post process (a stapling process and a punching process) with respect to a predetermined number of sheets, which were discharged from a copying machine.

In the sheet post-processing device, a predetermined number of the sheets are stacked as a sheet bundle on a post-processing tray. Further, after the post process such as the stapling process is performed with respect to the sheet bundle, the sheet bundle is discharged to a discharge tray.

However, upon transportation of sheets, there is a case where the sheets jam in a transport path of the sheet post-processing device. Thus, the transport path which cannot be opened causes such inconvenience that it is difficult to remove the jamming sheets (jam-disposal) from the transport path.

Thus, as to the sheet post-processing device, some techniques, which makes the jam-disposal easier, has been being developed conventionally.

For example, a document ①: Japanese Unexamined Patent Publication No. 129920/1998 (Tokukaihei 10-129920) (publication date: May 19, 1998) discloses a sheet post-processing device in which a staple unit can be drawn from a main body of the device.

The staple unit includes a staple tray (post-processing tray) and a stapler. Thus, when the unit is drawn, it is possible to perform the jam-disposal, with nothing above the staple tray. Further, it is possible to remove jamming staples and to supply staples efficiently.

Further, a document ②: Japanese Unexamined Patent Publication No. 143158/1999 (Tokukaihei 11-143158, corresponding to U.S. application Ser. Nos. 09/189,546 and 09/875,492)(publication date: May 28, 1999) discloses a sheet post-processing device in which it is possible to form a space above a staple tray.

That is, the device is arranged so that a sheet guide provided above the staple tray can be moved in the device. Further, this guide is moved in a direction away from the staple tray, so that it is possible to form an operating space (space for the jam-disposal), which is so wide that the jam-disposal can be performed, above the staple tray. Thus, an operator can insert his/her hand into the device so as to perform the jam-disposal above the staple tray.

However, the foregoing prior arts bear the following problems. That is, in the device of the document ①, the unit including the staple tray is moved in performing the jam-disposal, so that the consistency of the sheet bundle which is stacked on the tray is lost (when the staple tray moves and stops, the bundle moves in a moving direction of the tray due to inertial force).

Thus, the device bears a problem that the stapling process is not performed completely after the jam-disposal is performed.

Note that, the device has a jogger above the staple tray so as to keep the consistency of the bundle. However, the jogger can move parallel to a moving direction of the tray. Thus, when the staple tray moves and stops, the jogger also moves with the movement of the sheet bundle in the moving direction of the tray, so that it is impossible to keep the consistency of the sheet bundle.

Furthermore, even when the sheet bundle is made consistent again by the jogger after the staple tray is returned in the device, it is difficult to obtain the original consistency again (particularly, when the entire sheets move, it is so difficult to restore the consistency).

Furthermore, the device of the document ② is arranged so that an operating space is formed in the device by moving the sheet guide. Thus, it is required that a space for moving the sheet guide and a space used as the operating space are provided in advance, so that the device is bulky.

SUMMARY OF THE INVENTION

The present invention is to solve the conventional problems. Furthermore, the object of the present invention is to provide a compact sheet post-processing device by which a jam-disposal can be performed without losing consistency of sheets placed on a post-processing tray on which a post process such as a stapling process is performed.

In order to achieve the foregoing object, a sheet post-processing device of the present invention (present post-processing device) which places sheets discharged from an image forming device on a post-processing tray and performs a post process with respect to the sheets that have been placed on the post-processing tray, includes a moving mechanism for moving a tray counter part which is provided opposite to the post-processing tray to the outside of the device.

The present post-processing device is provided on image forming devices such as a copying machine, a printer, and a facsimile, and is to perform the post process with respect to sheets (recording paper etc.) on which images were formed. Here, the post process includes a stapling process for binding plural sheets, and a punching process for forming holes on edges of sheets by punching, and so on.

Further, the present post-processing device includes a post-processing tray which is used as a stand on which the post process is performed. That is, the present post-processing device is set to perform the post process with respect to sheets placed on the post-processing tray.

Further, specifically, the present post-processing device includes a moving mechanism for moving a portion (tray counter part) which is provided opposite to the post-processing tray to the outside of the image forming device.

Here, the tray counter part includes, for example, a transporting member for transporting sheets to the post-processing tray; a portion of a box body of the present post-processing device; a transport path etc. for discharging the sheets not via the post-processing tray; and a member (or a portion thereof) provided opposite to a sheet placing surface of the post-processing tray.

Further, to move the tray counter part to the outside means to move the tray counter part (at least one portion thereof) from a normal position (a position of the tray counter part in a case where the present post-processing device is in a driving state (a state in which the post process can be performed)), to the outside (outward) of the present post-processing device (to move the tray counter part toward the outside of the device, to move the tray counter part outward).

Further, the outside of the present post-processing device means an area exists out of the outline (outside of the outline) of the present post-processing device which is in a driving state. Note that, the present post-processing device, which is in a driving state, is in a closing state in which the tray counter part is not moved to the outside of the device.

In this way, in the present post-processing device, since the tray counter part can be moved to the outside of the device, it is possible to form a space (jam-disposal space) by opening the front side of the post-processing tray.

Thus, in the present post-processing device, when the jamming (jamming of sheets etc.) occurs in the vicinity of the post-processing tray, it is possible to remove the jamming sheet (perform the jam-disposal) so easily by using the jam-disposal space which is formed by moving the tray counter part to the outside.

Further, in the present post-processing device, the tray counter part is moved without moving the post-processing tray so as to form the jam-disposal space. Thus, it is possible to prevent a bad influence (deterioration of the consistency etc.) given to the sheets placed on the post-processing tray. Thus, even after performing the jam-disposal, it is possible to perform the post process of excellent quality (workmanship).

Further, the present post-processing device is set so that the tray counter part is moved to the outside of the device so as to form the jam-disposal space. That is, the tray counter part, a portion of the device, is made to stick outward so as to change a space occupied by the tray counter part into the jam-disposal space. Thus, it is not required that the space for the jam-disposal is provided in the device in advance. Thus, it is easy to realize miniaturization of the device.

Note that, when the tray counter part is moved outward, the entire tray counter part does not have to stick outward. A portion of the tray counter part may stick outward, as long as the sufficient jam-disposal space is formed in front of the post-processing tray.

For a fuller understanding of the nature and advantages of the invention, reference should be made to the ensuing detailed description taken in conjunction with the accompanying drawings.

DESCRIPTION OF THE EMBODIMENT

One embodiment of the present invention is described as follows.

Figure 2:
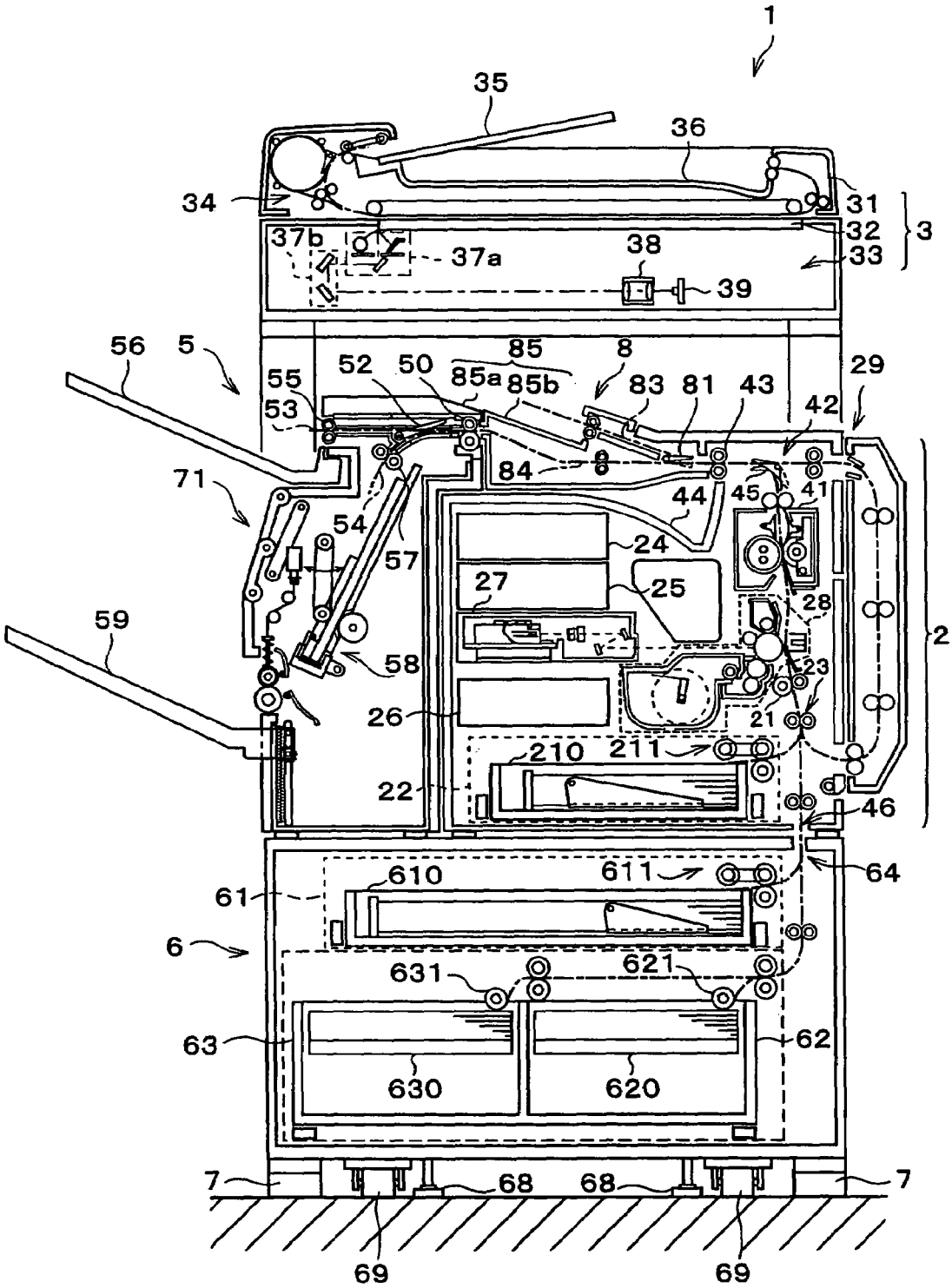
FIG. 2 is an explanatory drawing showing an arrangement of a digital complex machine including the sheet post-processing device.

FIG. 2 is an explanatory drawing showing an arrangement of a digital complex machine 1 according to the present embodiment. The digital complex machine (image forming device) 1 has functions as a copying machine, a printer, and a facsimile. Further, as shown in FIG. 2, the digital complex machine 1 includes: a print section 2; a scanner section 3; a sheet post-processing device 5; and a multistage feeding unit 6, in a system rack 7.

The scanner section 3 reads a document image, and includes: a document placing stand 32 made of transparent glass; an RADF 31; and a scanner unit (SU) 33.

The RADF 31 is a Reversing Automatic Document Feeder, and includes: a document transport section 34; a document tray 35; and a discharge tray 36.

The document transport section 34 transports documents, placed on the document tray 35, one by one to the document placing stand 32, and discharges a read document to the discharge tray 36 (automatic reading mode).

Further, the document transport section 34 can also turn the read document over and transport it to the document placing stand 32 again.

Further, the RAFD 31 is provided on the document placing stand 32 by a hinge (not shown) provided on the back side. The RAFD 31 rotates around the hinge as a center, so that the document placing stand 32 can be opened from a front side. Thus, by hand (manual operation), it is possible to place a document on the document placing stand 32 (manual operation reading mode) in the scanner section 3.

The SU 33 reads a document image, placed on the document placing stand 32, in every line, and includes: the first and second scanning units 37*a* and 37*b*; an optical lenz 38; and a CCD (photoelectric transfer element) 39.

The first scanning unit 37*a* exposes a document while moving at a fixed speed V, from left to right, along the document placing stand 32, and includes: light source; and the first reflecting mirror which leads light reflected from the document to the second scanning unit 37*b*.

The second scanning unit 37*b* follows the first scanning unit 37*a* at speed of V/2, and includes the second and third reflecting mirrors which lead the light reflected from the first reflecting mirror to the optical lenz 38 and the CCD 39.

The optical lenz 38 forms an image in accordance with the light reflected from the second scanning unit 37*b*. The CCD 39 converts the light reflected from the optical lenz 38 to an analog electric signal. Note that, the electric signal is converted to digital image data by an image controlling section 25 described later.

The print section (image forming device) 2 forms an image on a sheet (recording paper) in accordance with the image data, and includes: a print controlling section 24; an image controlling section 25; a power unit 26; a laser storing unit (LSU) 27; an electrophotography process section 28; and a sheet transporting mechanism 29.

The power unit 26 supplies power to respective members of the print section 2.

The print controlling section 24 controls all the processes in the digital complex machine 1. Further, the print controlling section 24 includes: a process control unit (PCU) substrate which controls the electrophotography process; and an interface substrate which can receive image data from an outside device (both substrates are not shown).

The image controlling section 25 converts analog image data, which is outputted from the scanner section 3, to digital image data which can be processed in the digital complex machine 1. Further, the image controlling section 25 can convert image data, which is received from an outside device, to digital image data which can be processed in the digital complex machine 1. Further, the image controlling section 25 includes: an image control unit (ICU: not shown) substrate which performs a predetermined image process with respect to these image data so as to transmit the processed data to the LSU 27.

The LSU 27 includes: a laser diode; a collimator lenz; a f-θ lenz; a polygon mirror; and a reflecting mirror. Further, the LSU 27 irradiates laser beam so as to form an electrostatic latent image on a photosensitive drum of the electrophotography process section 28 in accordance with the image data which was outputted from the image controlling section 25.

The electrophotography process 28 includes: a photosensitive drum 21; and a charger, a developer, a transcriber, a cleaner, which are provided on the periphery of the photosensitive drum 21 (all of them are not shown). Further, the electrophotography process section 28 can develop the electrostatic latent image on the photosensitive drum 21 so as to generate a toner image, and can perform electrostatic transfer with respect to a sheet.

The sheet transporting mechanism 29 can supply sheets to the electrophotography process section 28, and can fix the image transcribed on the sheet, and further, can discharge the sheet to the outside. Further, as shown in FIG. 2, the sheet transporting mechanism 29 includes: a sheet feeding cassette 22; a transport section 23; a fixing device 41; a resupplying path 42; a switching gate 45; a discharging roller 43; a double surfaces copying unit 10; a discharge tray 44; and a relay transport unit 8.

The transport section 23 transports sheets to a predetermined transcribing position (a position where the transcribing device is provided) of the electrophotography process section 28.

The sheet feeding cassette (sheet supplying section) 22 includes: a storage tray (sheets storage tray) 210 for storing sheets; and a pickup roller (separating and supplying means) 211 which transports the sheets one by one (separates the sheets one by one and supplies each sheet) from the tray 210, and can transport the sheets to the transport section 23. Note that, the sheet feeding cassette 22 is provided on a front side of the digital complex machine 1 so that the sheet feeding cassette 22 can be drawn so as to supply the sheet feeding cassette 22 with the sheets easily.

The fixing device 41 heats and presses the sheet so as to fix the toner image transcribed on the sheet.

With the resupplying path 42 and the discharge tray 85, the double surfaces copying unit 10 prints on the both surfaces of the sheet. That is, the double surfaces copying unit 10 is to resupply the sheet to the transport section 23 so that an image is formed on the underside of the sheet, after the fixer fixes the toner image.

The resupplying path 42 is used to transport the sheets on which images were fixed to the double surfaces copying unit 10.

The switching gate 45 is provided on the resupplying path 42. Further, the switching gate 45 is set to switch to the first state (continuous line), in which the fixed sheet is discharged to the side of the relay transport unit 8, or to the second state (broken line), in which the sheet returned from the relay transport unit 8 is inserted into the double surfaces copying unit 10.

The discharging roller 43 is set to be rotatable in both clockwise and anti-clockwise directions, and transports the sheet discharged from the fixing device 41 to the discharge tray 44, the resupplying path 42, or the relay transport path 8 described later. The discharge tray 44 is used when the relay transport unit 8 is detached.

The relay transport unit 8 introduces the sheet discharged from the print section 2 into the sheet post-processing device 5. Further, the relay transport unit 8 can temporarily support the sheet whose surface was printed so as to print the underside of the sheet. Further, the relay transporting unit 8 includes: a switching gate 81; the first transport path 83; the second transport path 84; and a discharge tray 85.

The first transport path 83 transports the fixed sheet to the discharge tray 85. While, the second transport path 84 transports the fixed sheet to the sheet post-processing device 5. Further, the switching gate 81 switches transport paths of the sheet (the first transport path 83 or the second transport path 84).

The discharge tray (double surfaces copying tray) 85 discharges the fixed sheet, and includes: a top face 85*b* of the relay transport unit 8; and a top face 85*a* of the sheet post-processing device 5. Further, the discharge tray 85 is used as a reverse transport path of the sheet, and the discharge tray 85, the double surfaces copying unit 10, and the resupplying path 4 realize image formation on both surfaces of the sheet.

Further, the underside of the print section 2 has a sheet receiving opening 46 to insert the sheet transported from the multistage feeding unit 6, into the sheet transporting mechanism 29.

The multistage feeding unit 6 is an outside sheet supplying device provided on the underside of the print section 2, and includes: three sheet supplying sections 61, 62, and 63; a sheet discharging opening 64; a moving roller 69; and a fixing section 68.

The respective sheet supplying sections 61, 62, and 63 include: sheet storage trays 610, 620, 630; and pickup devices (separating and transport sections) 611, 621, and 631. The sheet storage trays 610, 620, and 630 store sheets whose type and size are desired by the user.

The pickup devices 611, 621, 631 transport sheets, stored in any one of the sheet storage trays 610, 620, and 630, via the sheet discharging opening 64 (connected to the sheet receiving opening 46) provided on the top face of the unit, to the sheet transporting mechanism 29 of the print section 2.

Note that, in the digital complex machine 1, the sheet supplying sections 61, 62, 63 are set so that each of them is selected according to the size desired by the user, and is operated. Further, the sheet storage trays 610, 620, and 630 are drawn to the front side of the multistage feeding unit 6 so as to supply sheets to the sheet supplying sections 61, 62, and 63. Further, the sheet supplying sections 62 and 63 are set to store sheets of the same size.

The fixing section 68 and the moving roller 69 control a setting position of the multistage feeding unit 6. That is, the fixing section 68 is lifted away from a floor and the multistage feeding unit 6 is supported by the moving roller 69, so that it is possible to move the multistage feeding unit 6. Further, the fixing section 68 is lowered so as to touch the floor, so that it is possible to fix the multistage feeding unit 6.

Thus, the digital complex machine 1 is arranged so that the multistage feeding unit 6 is provided in a predetermined position of the system rack 7, with the print section 2 and the sheet post-processing device 5 placed successively on the top face of the multistage feeding unit 6.

Next, the sheet post-processing device 5, a characteristic arrangement of the digital complex machine, is described as follows.

The sheet post-processing device 5 is a box-shaped device provided next to the print section 2. The sheet post-processing device 5 performs a post process such as a stapling process with respect to the sheet discharged via the relay transport unit 8 from the print section 2.

Figure 1:
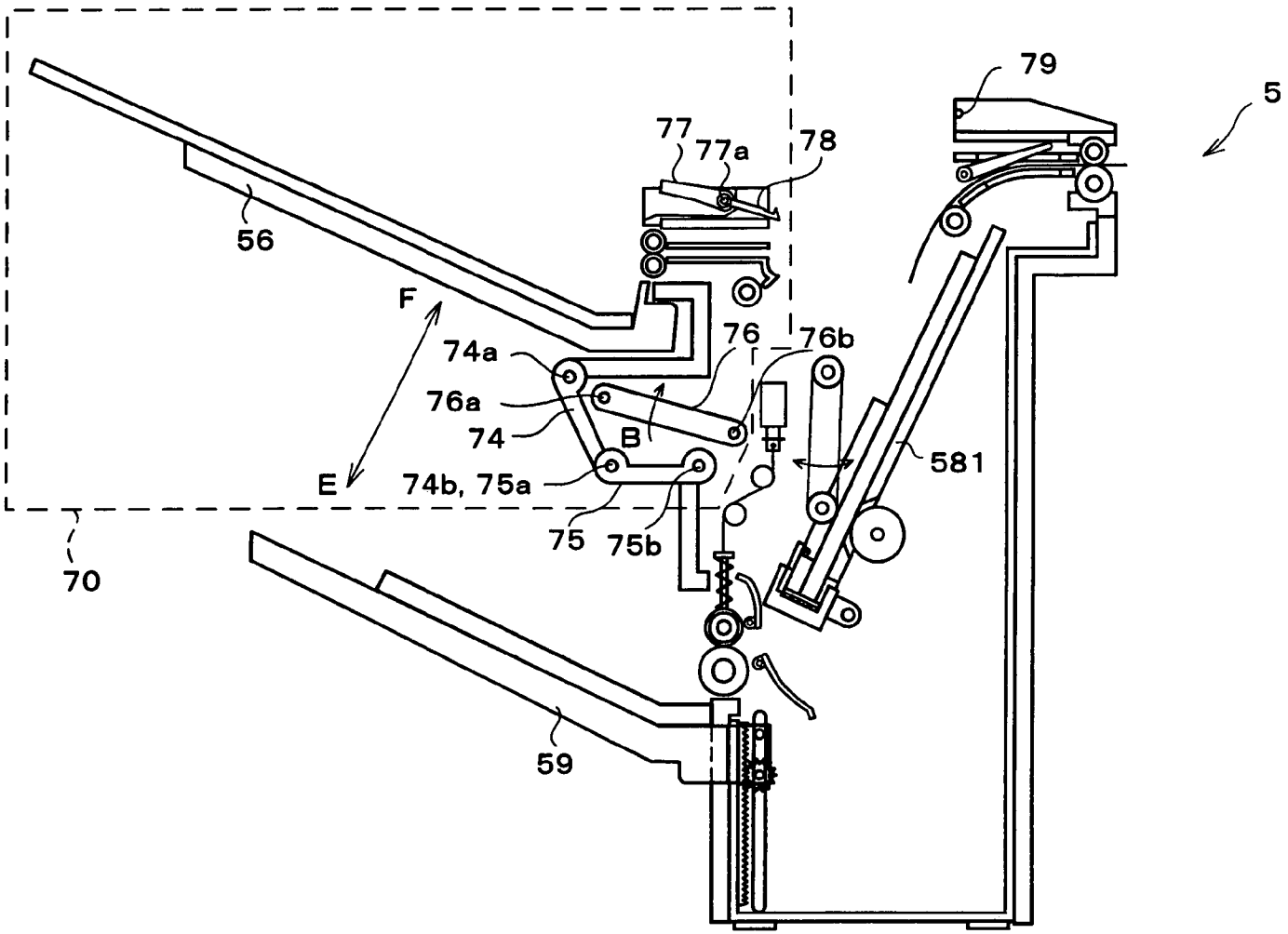
FIG. 1 is an explanatory drawing showing a state in which a jam-disposal is performed in a sheet post-processing device according to one embodiment of the present invention.
Figure 3:
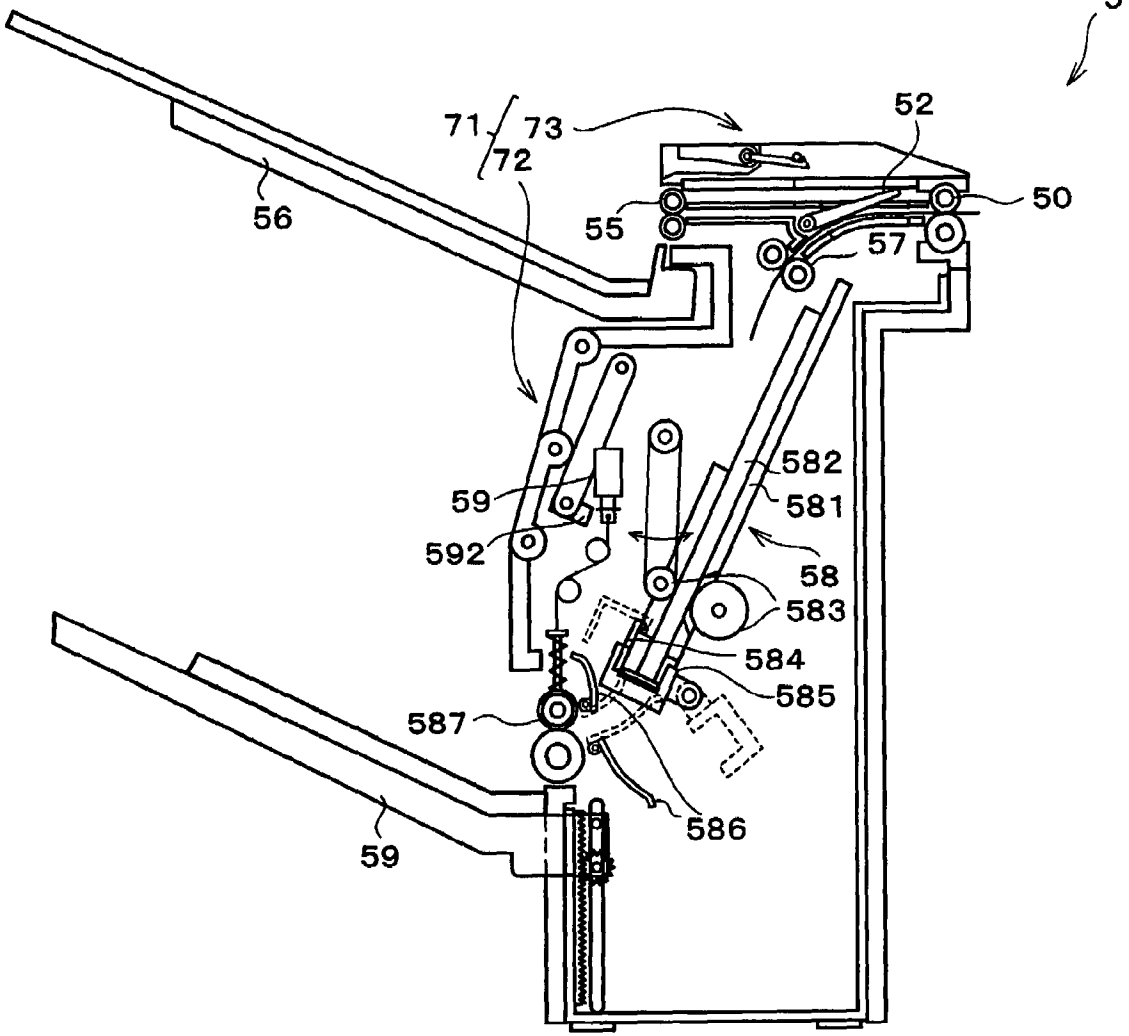
FIG. 3 is an explanatory drawing showing a concrete arrangement of the sheet post-processing device.

FIG. 3 is an explanatory drawing which concretely shows the sheet post-processing device 5. Further, FIG. 1 is an explanatory drawing showing the sheet post-processing device 5 in which a jam-disposal is performed. As shown in FIG. 1 and FIG. 3, the sheet post-processing device 5 includes: a feed-in roller 50; a switching gate 52; the first and second transport paths 53 and 54; the first and second discharging rollers 55 and 57; the first and second discharge trays 56 and 59; a stapling processing section 58; and a jam-disposal mechanism 71.

The feed-in roller (a pair of rollers) 50 incorporates (introduces) the sheet transported via the relay transporting unit 8 from the print section 2 into the sheet post-processing device 5. The switching gate 52, provided on the downstream side with respect to the feed-in roller 50, transports the incorporated sheet to any one of the first and second transport paths 53 and 54 (see FIG. 2).

The first transport path 53 is used to discharge sheets which are not subjected to the stapling process. Further, the first discharging roller 55, provided on an end of the first transport path 53, discharges the sheet transported through the first transport path 53 to the first discharge tray 56. That is, the first discharge tray 56 is a tray on which sheets which are not subjected to the stapling process are loaded.

The second transport path 54 is used to discharge sheets which are subjected to the stapling process. The second discharging roller 57, provided on an end of the second transport path 54, introduces the sheet transported through the second transport path 54 into the stapling processing section 58.

The stapling processing section 58 performs the stapling process with respect to the sheet transported via the second transport path 54. Further, the second discharge tray 59 is a tray on which sheets processed by the stapling processing section 58 are loaded.

A jam-disposal mechanism (moving mechanism) 71 is a mechanism by which the sheet post-processing device 5 is transformed so that it is easy for the user to perform the jam-disposal in a case where jamming of sheet takes place in the sheet post-processing device 5. Note that, a concrete description of the jam-disposal mechanism is given later.

Next, an arrangement of the stapling process section 58 of the sheet post-processing device 5 is described concretely.

As shown in FIG. 3, the stapling process section 58 includes: a staple tray 581; an adjusting plate 582; a roller/belt pair transport section (discharging member) 583; a ratching guide 584; a stapler 585; a discharging guide (discharging member) 586; and a discharging roller (discharging member) 587.

The staple tray (post-processing tray) is a tray for bundling sheets which are subjected to the stapling process and stacking the bundled sheets.

The roller/belt pair transport section 583 is a transporting member for loading the sheets incorporated from the second discharging roller 57 on the staple tray 581. Further, the roller/belt pair transport section 583 has a function for discharging the sheet bundle, which has been subjected to the stapling process, from a bottom side of the staple tray 581 toward the discharging roller 587.

The adjusting plate 582 adjusts side ends of the sheet bundle (ends of the sheets in a direction orthogonal to a transporting direction) on the staple tray 581. The ratching guide 584 is a guide for adjusting a lower edge of the sheet bundle (an edge on the downstream side in the transporting direction) on the staple tray 581.

The stapler 585 is stacked on the staple tray 581, and performs the stapling process with respect to the sheet bundle adjusted by the ratching guide 584. Note that, the stapler 585 is set to perform the stapling process with respect to the sheet bundle so that a lower edge of the sheet bundle is bound on the staple tray 581.

The discharging guide 586 is a guide for leading the sheets, which has been subjected to the stapling process, to the discharging roller 587. The discharging roller (pair of discharging rollers) 587 discharges the sheets, which has been subjected to the stapling process, to the discharge tray 59. Further, in the discharging roller 587, an upper roller is connected to a solenoid 589. The solenoid 589 controls a size of a gap between two rollers (discharging size: a gap which exists between the two rollers) of the discharging roller 587.

Here, a procedure of the stapling process in the sheet post-processing device is described as follows. First, a sheet led from the second transport path 54 to the staple tray 581 touches the roller/belt pair transport section 583. Further, the roller/belt pair transport section 583 fillips the sheet so that a lower end of the sheet hits on the ratching guide 584. Next, the adjusting plate 582 adjusts the side ends of the sheets.

Further, a predetermined number of the sheets are stacked as a sheet bundle on the staple tray 581. Thereafter, the stapler 585 performs the stapling process with respect to the sheet bundle.

After performing the stapling process, first, the stapler 585 moves to a position shown by a broken line in FIG. 3. Next, the discharging guide 586 moves to a position shown by a broken line, and forms a transport path leading to the discharging roller 587. Thereafter, the ratching guide 584 moves to a position shown by a broken line, so that the sheet is led to the discharging roller 587.

Note that, in the digital complex machine 1, a thickness of the sheet bundle which has been subjected to the stapling process is measured by a sensor (not shown). Further, when the thickness of the sheet bundle is judged to be smaller (thinner) than a predetermined value, the sheet is discharged as it is by the discharging roller 587 in which a discharging size is set to be a normal value (default value).

While, when the thickness of the sheet bundle is thicker than the predetermined value, the solenoid 589 becomes ON in accordance with the controlling section (not shown). By this, the upper roller of the discharging roller 587 is lifted, and the discharging size becomes larger.

Thereafter, the roller/belt pair transport section 583 transports the sheet bundle to a position where the discharging roller 587 can pinch (hold) the sheet. Further, the solenoid becomes OFF in accordance with the controlling section. Thereafter, the sheet bundle is pinched and transported, so that the sheet bundle is discharged to the discharge tray 59.

Note that, the predetermined value of the thickness of the sheet bundle is such thickness that the discharging roller 587 can pinch the sheet bundle of the thickness. Further, when the thickness of the sheet bundle is thinner than the predetermined value, the discharging roller 587 may be arranged so that the upper roller of the discharging roller 587 is lowered by the controlling section and the solenoid 589, so as to make the discharging size smaller.

Next, the jam-disposal mechanism 71, a characteristic arrangement in the sheet post-processing device 5, is described as follows.

Figure 4:
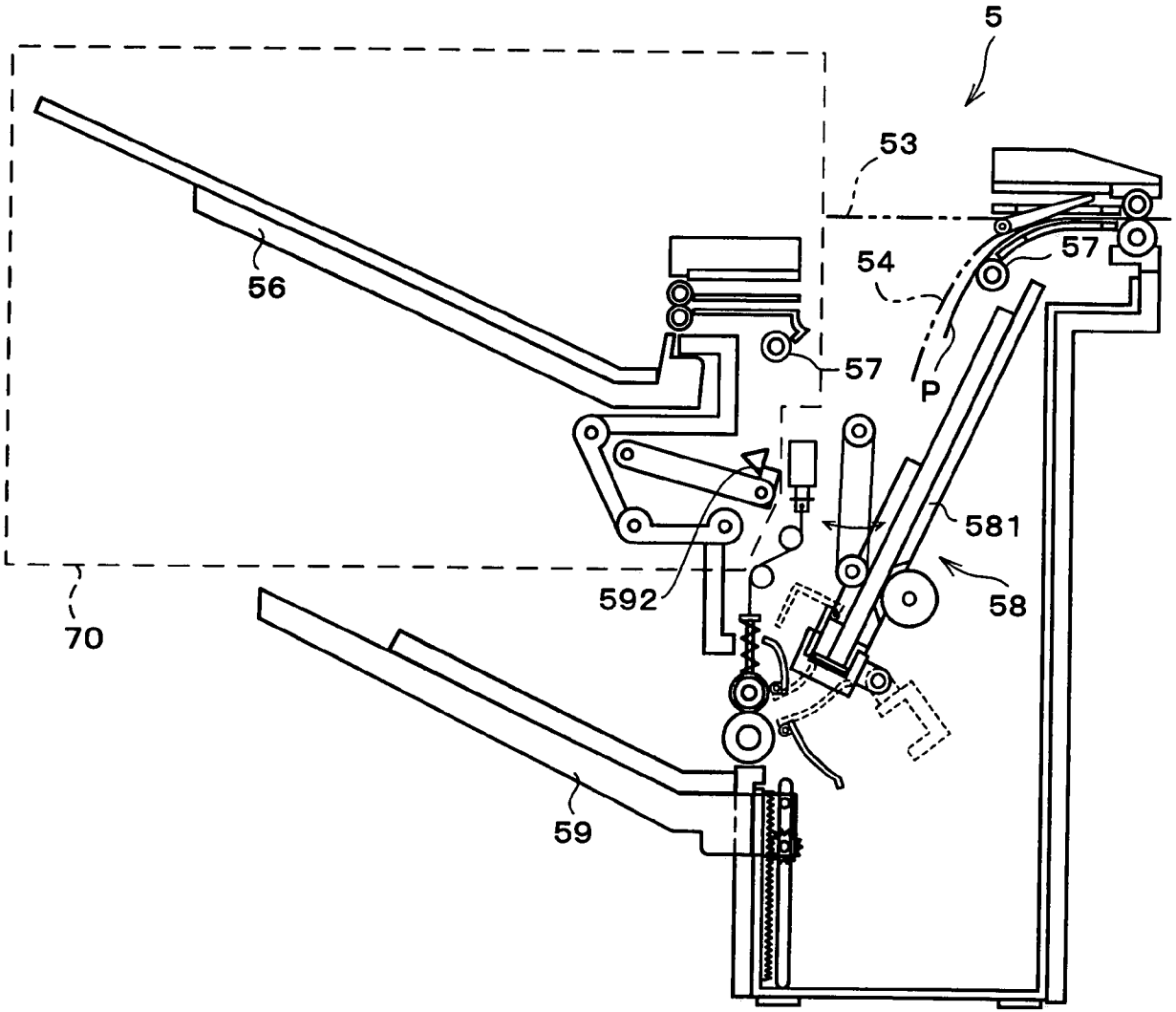
FIG. 4 is an explanatory drawing showing a state in which the jam-disposal is performed in a sheet post-processing device in a case where jamming of sheets, which are subjected to a stapling process, takes place.
Figure 5:
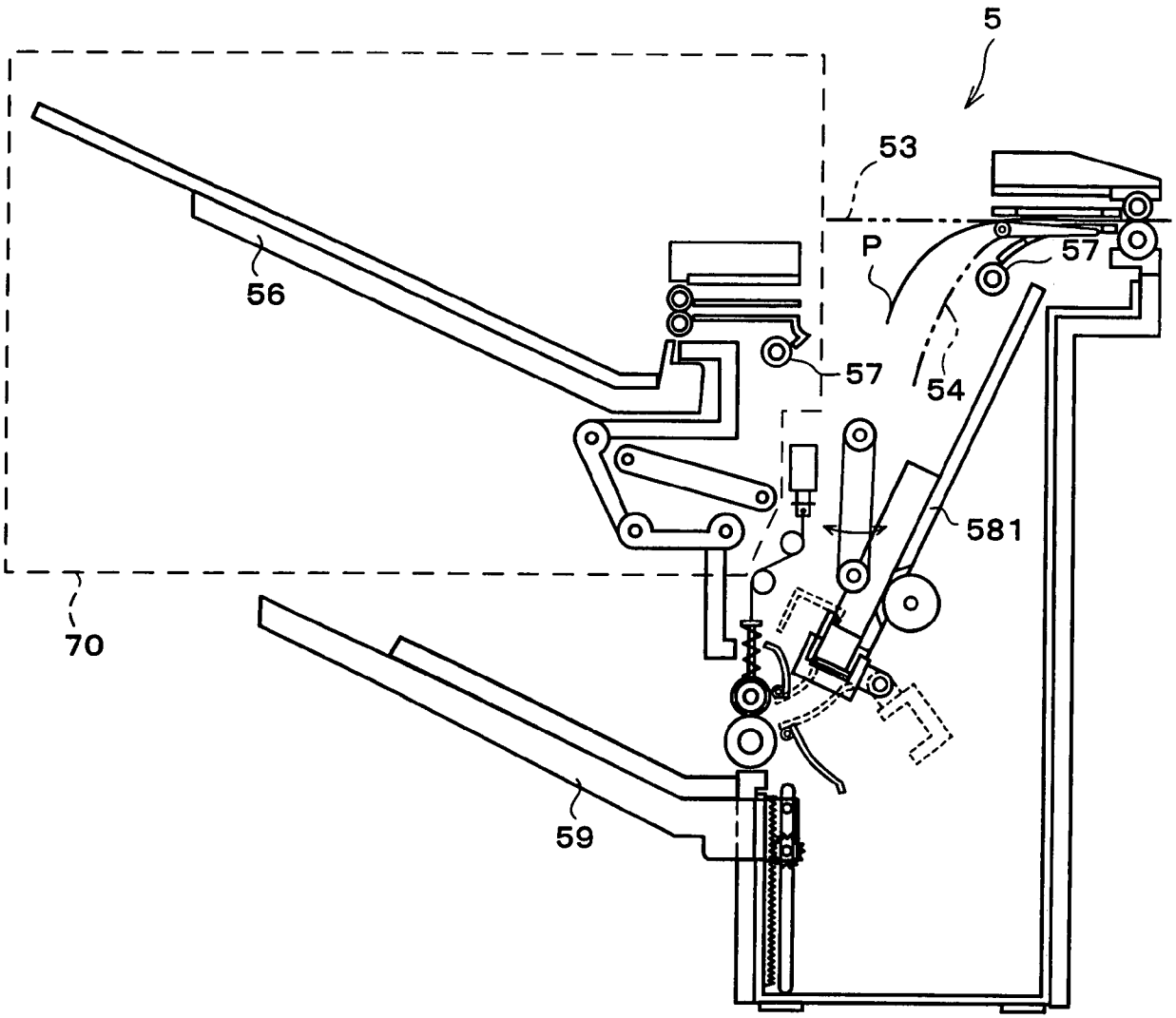
FIG. 5 is an explanatory drawing showing a state in which the jam-disposal is performed in a sheet post-processing device in a case where jamming of sheets, which are not subjected to a stapling process, takes place.

FIG. 4 and FIG. 5 are explanatory drawings showing a state in which the jam-disposal is performed (jam-disposal state). FIG. 4 shows a jam-disposal state in a case where jamming of sheet, which occurs on the second transport path 54 (jamming of a sheet P being transported to the staple tray 581), is disposed of. Further, FIG. 5 shows a jam-disposal state in a case where jamming of sheet, which occurs on the first transport path 53 (jamming of a sheet P which is not subjected to the stapling process and is discharged as it is), is disposed of.

As shown in these drawings, in the sheet post-processing device 5, it is possible to divide the first transport path 53, provided above the staple tray 581, into two paths, when the jam-disposal is performed.

Further, a moving section 70, which includes a portion opposite to the staple tray 581 (tray counter part: a portion provided on the left with respect to the staple tray 581) and a portion provided above the staple tray 581 (upper part), is arranged so as to move away from a sheet placing surface of the staple tray 581.

Note that, the moving section 70 moves along a diagonal direction (diagonally downward) of the staple tray 581, so that a portion of the moving section 70 sticks outward. Further, the moving section 70 is made up of a portion of the first transport path 53, a portion of a side face of the sheet post-processing device 5, and the first discharge tray 56.

Thus, in the sheet post-processing device 5, it is possible to open the counter part (spaces in front and above the staple tray 581) opposite to the sheet placing surface of the staple tray 581.

The jam-disposal mechanism 71, which realizes the foregoing moving section 70, is described as follows.

Figure 6:
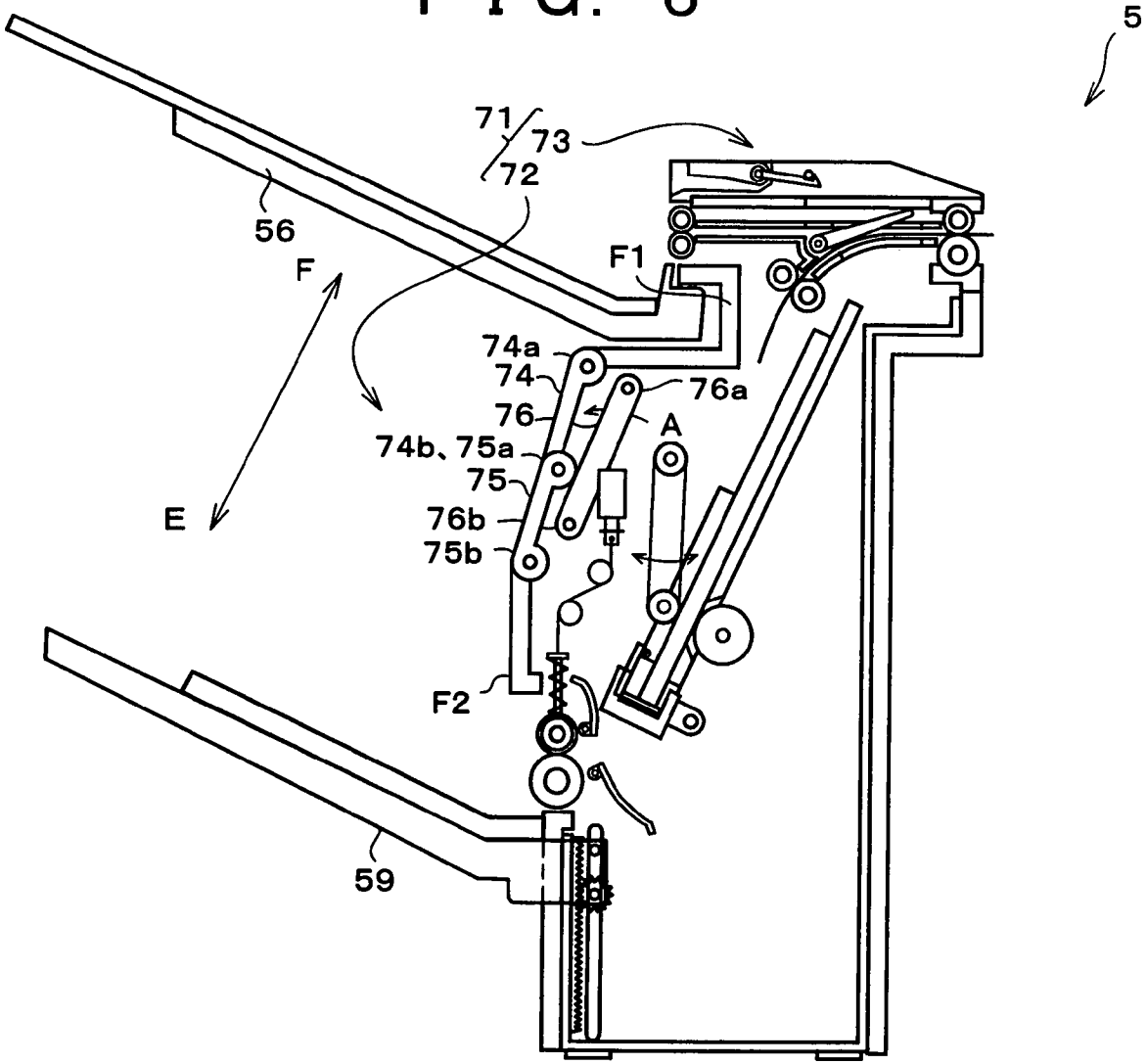
FIG. 6 is an explanatory drawing showing a jam-disposal mechanism in the sheet post-processing device.

FIG. 6 is an explanatory drawing showing an arrangement of the jam-disposal mechanism 71. As shown in FIG. 6, the jam-disposal mechanism 71 includes: a linking mechanism 72 provided on the side face of the sheet post-processing device 5; and a locking mechanism 73 provided on an upper portion of the sheet post-processing device 5.

As shown in FIG. 6, the linking mechanism (moving mechanism, movement controlling section) 72 includes: a linking member 76; and the first and second movable walls 74 and 75.

First, the linking member 76 is described as follows. The linking member (moving mechanism, movement controlling section) 76 is connected to both the main body and the moving section of the sheet post-processing device 5 (see FIG. 4), and has a function for controlling movement of the moving section 70. That is, as shown in FIG. 6, an upper end 76*a* of the linking member 76 is supported rotatably by a frame (not shown) of the moving section 70. While a lower end 76*b* is supported rotatably by a main body frame (not shown) of the sheet post-processing device 5.

Further, a stopper 592 (see FIG. 3 and FIG. 4) which controls anti-clockwise rotation of the linking member 76 is provided in the vicinity of the lower end 76*b* of the linking member 76. By this, in a state shown in FIG. 4 or FIG. 5, the linking member 76 rotates around the lower end 76*b* as a center in an A direction, only at a predetermined angle. Further, the moving section 70 stops at a position where the counter part opposite to the sheet placing surface of the staple tray 581 is opened. Note that, in a state shown in FIG. 6, clockwise rotation of the linking member 76 is prevented by the locking mechanism 73 described later.

The first and second movable walls (moving mechanism, movement controlling section) 74 and 75 make up a side wall of the sheet post-processing device 5. The upper end 74*a* of the first movable wall 74 is supported rotatably by a frame F1 of the moving section 70. Further, the lower end 75*b* of the second movable wall 75 is supported rotatably by a body frame F2 of the sheet post-processing device 5.

Further, the lower end 74*b* of the first movable wall 74 and the upper end 75*b* of the second movable wall 75 are connected rotatably to each other.

Figure 7:
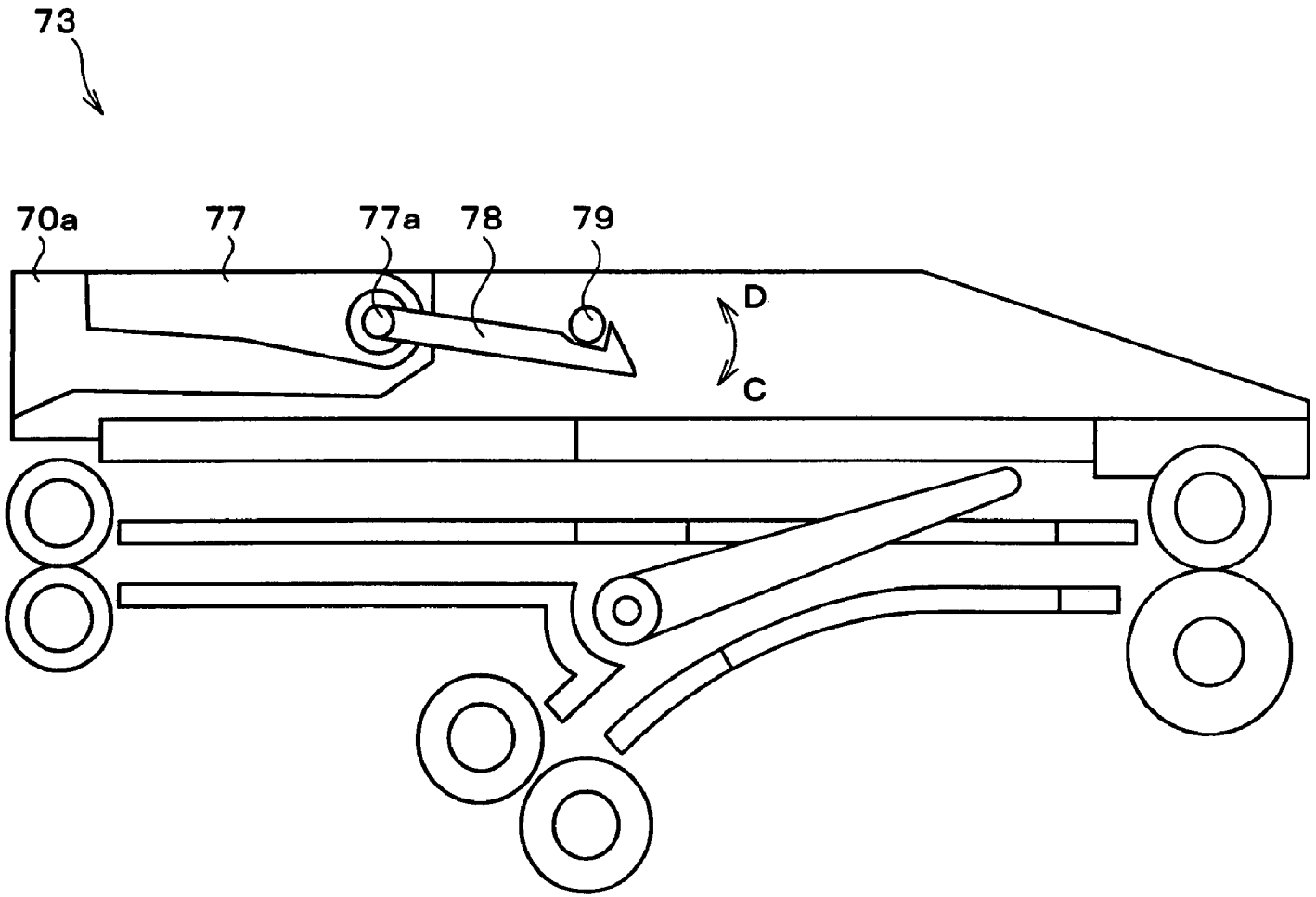
FIG. 7 is an explanatory drawing showing a locking mechanism which is included in the jam-disposal mechanism shown in FIG. 6.

Next, the locking mechanism (moving mechanism) 73 is described as follows. FIG. 7 is an explanatory drawing showing an enlarged view of the locking mechanism 73. As shown in FIG. 7, the locking mechanism 73 includes: an unlocking lever 77; a hook member 78; and a pin 79.

The unlocking lever (unlocking holding section: moving mechanism, locking section) 77 is provided on a side face of a top part 70*a* of the moving section 70, and is set to be able to rotate around a rotating axis 77*a* as a center. The hook member (first locking member: moving mechanism, locking section) 78 and the unlocking lever 77 are formed as one body. Further, the hook member 78 rotates around the rotating axis 77*a* as a center in C and D directions, according to the rotation of the unlocking lever 77.

Further, an energizing member (not shown) which energizes the hook member 78 in the D direction (anti-clockwise direction) is provided on the rotating axis 77*a*. By this, the hook member 78 is arranged so as to be hooked to the pin (second locking member: moving mechanism, locking section) 79 provided on a top part of the main body of the sheet post-processing device 5.

That is, the hook member 78 is hooked to the pin 79, so that the moving section 70 is fixed on the main body of the sheet post-processing device 5. Further, the moving section 70 is fixed on the sheet post-processing device 5, so that the sheet post-processing device 5 becomes in an operating state (normal state) in which sheets discharged from the print section 2 is subjected to the post process (a position of an operating section 70 in a normal state is a normal position).

In the sheet post-processing device 5 having the jam-disposal mechanism 71, the hook member 78 is released from the pin 79 by rotating the unlocking lever 77 upward by hand. By this, the hook member 78, provided on the unlocking lever 77 as one body, rotates around the rotating axis 77*a* as a center in the C direction (clockwise direction), so that the hook member 78 is released from the pin 79.

When the moving section 70 is led by hand in an E direction (diagonally down to the left) shown in FIG. 6, the linking member 76 rotates in the A direction. Further, as shown in FIG. 1, the first and second movable walls 74 and 75 rotate (move diagonally) in an anti-clockwise direction.

That is, the moving section 70 moves in the E direction with almost the same shape (almost the same shape as a shape at the normal position), and is placed at a position (jam-disposal position) where a portion of the moving section 70 sticks out of the sheet post-processing device 5.

Thus, a front space and an upward space of the sheet placing surface of the staple tray 581 are enlarged, so that the sheet post-processing device 5 becomes in the jam-disposal state in which an open space is formed above the staple tray 581.

While, when the sheet post-processing device 5 is returned from the jam-disposal position to the normal position (from the jam-disposal state to the normal state), the moving section 70 is moved by hand in an F direction (diagonally up to the right). In this way, the moving section 70 returns almost to a former position (normal position), so that the hook member 78 is hooked to the pin 79, and the moving section 70 is fixed (hooked) on the main body of the sheet post-processing device 5.

As described above, the sheet post-processing device 5 includes the jam-disposal mechanism by which a portion of the moving section 70 opposite to the staple tray 581 is moved to the outside of the device.

That is, in the sheet post-processing device 5, it is possible to move the moving section 70 to the outside of the device, so that it is possible to form a space (jam-disposal space) by opening the front side of the staple tray 581.

Thus, in the sheet post-processing device 5, when jamming of sheet occurs in the vicinity of the staple tray 581, it is possible to perform the jam-disposal process so easily by using the jam-disposal space which is formed by moving the moving section 70.

Further, in the sheet post-processing device 5, the moving section 70 is moved instead of moving the staple tray 581 so as to form the jam-disposal space. Thus, it is possible to prevent a bad influence (deterioration of the consistency etc.) given to the sheets placed on the staple tray 581. Thus, even after the jam-disposal, it is possible to perform the post process of excellent quality (workmanship).

Further, in the sheet post-processing device 5, the moving section 70 is set to move to the outside of the device so as to form the jam-disposal space. Thus, it is not required that a space for the jam-disposal is provided inside the device in advance.

Further, in the sheet post-processing device 5, the moving section 70 is set to move in a direction different from a position where the print section 2 is provided. Thus, it is possible to move the moving section 70 without changing a layout of the sheet post-processing device 5 and the print section 2, so as to form the jam-disposal space.

Further, in the sheet post-processing device 5, the moving section 70 is not required to be provided between the staple tray 581 and the print section 2. Thus, it is possible to widen moving directions of the moving section 70.

Further, the jam-disposal mechanism 71 is set so that the moving section 70 is moved diagonally downward with respect to the staple tray 581. Thus, it is possible to perform the jam-disposal without influencing operations or providing states of other devices (scanner section 3 etc.) provided above the sheet post-processing device 5 (above the moving section 70).

Further, since the moving section 70 is moved more downward than the staple tray 581, it is possible to form the wide jam-disposal space without setting the moving amount of the moving section 70 to be large in a horizontal direction, and it is possible to reduce a substantial floor area occupied by the device (area occupied by the device in a case where the moving section 70 is moved).

Further, the jam-disposal mechanism 71 includes: a hook member 78 and a pin 79 for fixing the moving section 70 on the normal position opposite to the staple tray 581; and the unlocking lever 77 for releasing the moving section 70. Further, the jam-disposal mechanism 71 has the linking mechanism 72 for controlling a position of the moving section 70 between the normal position and the jam-disposal position set diagonally downward with respect to the normal position. Thus, since the moving section 70 at the normal position is moved to the jam-disposal position easily, it is possible to form the jam-disposal space.

Further, in the sheet post-processing device 5, a portion placed above the staple tray 581 is included in the moving section 70. Thus, it is possible to form an open space above the staple tray 581, so that it becomes easy to see the staple tray 581. Further, it is possible to form the wide jam-disposal space without setting the moving amount of the moving section 70 to be large.

Further, it is possible to look down the vicinity of the staple tray 581 from the diagonal upside, so that it is easy to perform the jam-disposal. Thus, it is possible for an operator to insert his/her hand from the side of the counter part (front side) opposite to the staple tray 581 so as to grab the jamming sheet, and to move his/her hand upward so as to pull the jammed sheet out of the transport path, along a transporting direction of the transport path.

That is, it is possible to remove the jamming sheet from both directions: from the side of the counter part and from the upside, so that it is easy to perform the jam-disposal (it is difficult to pull the sheet in a direction orthogonal to the transporting direction of the transport path).

Figure 8:
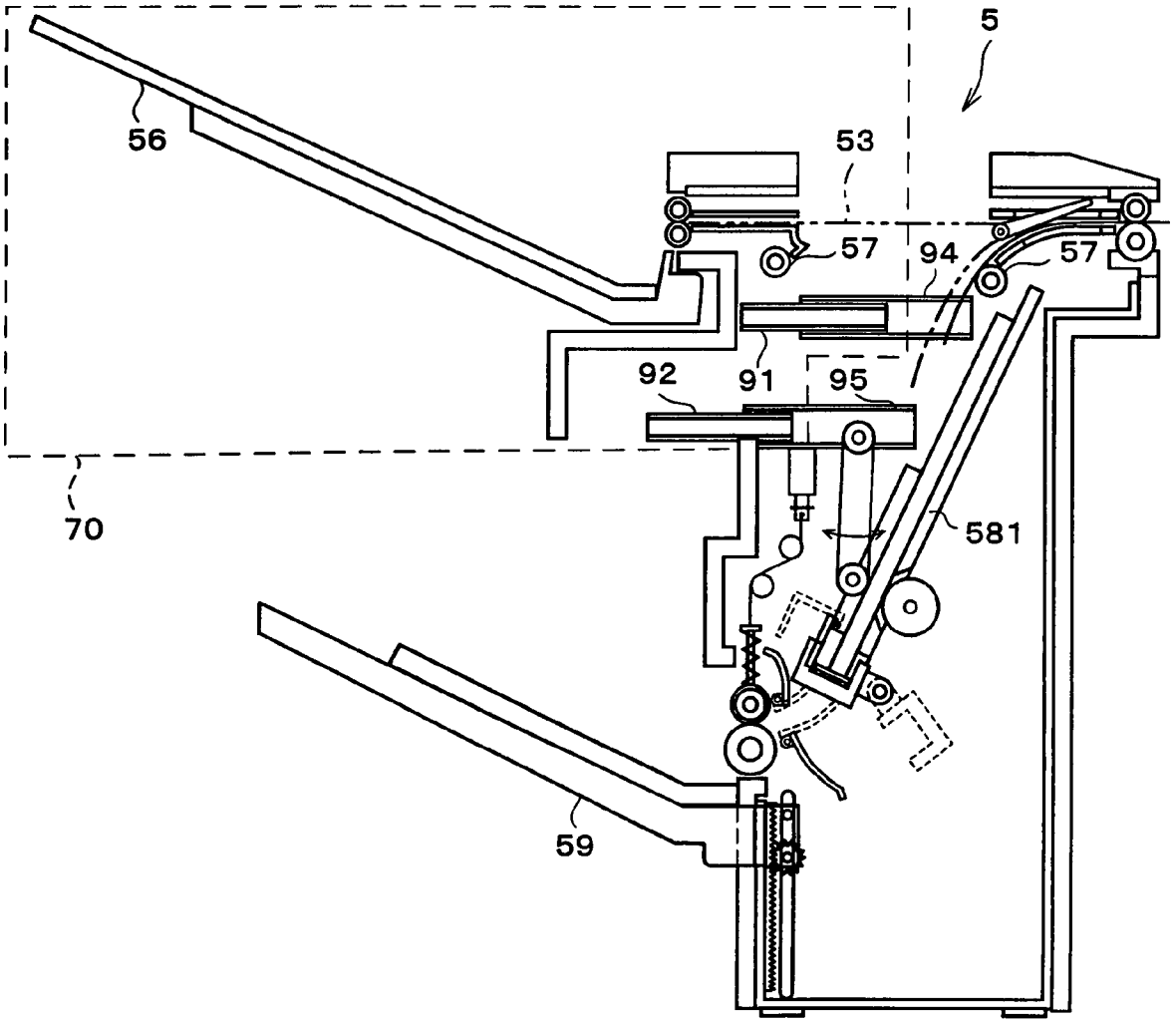
FIG. 8 is an explanatory drawing showing another state in which jam-disposal is performed in the sheet post-processing device.

Note that, in the present embodiment, the moving section 70 of the jam-disposal mechanism 71 of the sheet post-processing device 5 is moved in the E direction of FIG. 1. However, the arrangement of the jam-disposal mechanism 71 is not restricted to this, but may be arranged to be moved in a horizontal direction. FIG. 8 is an explanatory drawing showing the sheet post-processing device 5 having the jam-disposal mechanism 71 with the moving section 70 which can move horizontally.

According to the arrangement, the moving section 70 is connected to the main body of the sheet post-processing device 5 by three slide mechanisms. That is, in this arrangement, as shown in FIG. 8, the first and second sliders 91 and 92 are provided on the side face of the back side of the moving section 70, and positions on which the sliders are provided respectively are different in the height. Further, the third slider (not shown) is provided on the side face of the front side, and a position on which the third slider is provided has the same height as that of the second slider.

While, in the sheet post-processing device 5, the first and second slide guides 94 and 95 are provided on positions corresponding to the first and the second sliders 91 and 92, and the third slide guide (not shown) is provided on a position corresponding to the position of the third slider. Further, the device is arranged so that the moving section 70 can be moved so as to form an open space above the sheet placing surface of the staple tray 581 by sliding the sliders in the slide guides respectively.

Also in this arrangement, it is possible to easily provide other devices above the sheet post-processing device 5. Further, in this case, the moving section 70 moves horizontally, so that it is possible to simplify a structure of the jam-disposal mechanism 71.

Figure 9:
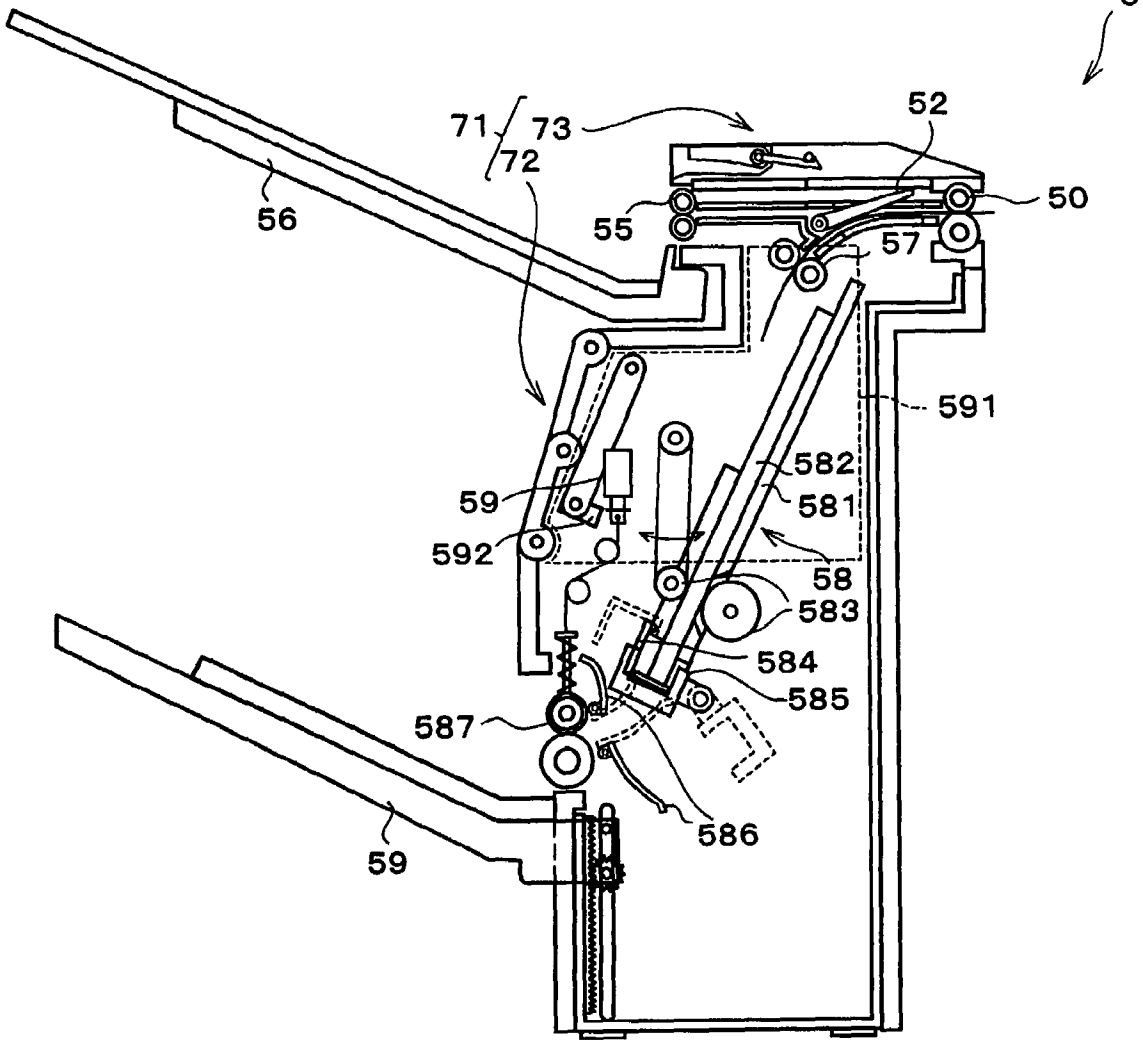
FIG. 9 is an explanatory drawing showing a beside-tray part of the sheet post-processing device.

Further, in the present embodiment, the moving section 70 which is provided above and in front of (on the counter part opposite to) the staple tray 581 is moved. However, the arrangement is not restricted to this, but the beside-tray part 591 of the sheet post-processing device 5, as shown in FIG. 9, may be arranged to be moved outward. Note that, the beside-tray part 591 is made up of members (or a portion of each member: a frame, or a box body etc. of the sheet post-processing device 5) positioned on the front side and the back side of the sheet post-processing device 5.

In this arrangement, the open space can be formed beside the staple tray 581, so that it is possible to form the wide jam-disposal space without enlarging the moving amount of the moving section 70. Further, it is possible to remove the jamming sheet from at least two directions: from the counter part and from the upside, so that it is easy to perform the jam-disposal process.

Further, in the sheet post-processing device 5, when the moving section 70 is moved outward, the entire moving section 70 may stick outward, and a portion of the moving section 70 may stick outward. In the sheet post-processing device 5, a portion of the moving section 70 may stick outward as long as the sufficient jam-disposal space is formed in front of the staple tray 581.

Further, in the present embodiment, the sheet post-processing device 5 is a device, provided with the stapling processing section 58, which performs the stapling process with respect to sheets. However, the function of the sheet post-processing device 5 is not restricted to this, but the sheet post-processing device 5 may be used to perform other post processes (punching process etc.).

Further, in the present embodiment, when the sheet bundle which has been subjected to the stapling process is discharged, a sensor measures a thickness of the sheet bundle, and the solenoid 589 (discharging size) is controlled in accordance with the detecting result. However, this function is not restricted to the sensor, but a counter may be provided so as to count the number of the sheets making up the sheet bundle. Further, when the sheet bundle has less sheets than a predetermined number, the sheet bundle may be discharged to the discharge tray 59 as it is by the discharging roller 587. Further, the device is arranged so that the discharging size is made larger when the sheet bundle has more sheets than the predetermined number.

Further, in the present embodiment, the stapler 585 binds a lower edge of the sheet bundle on the staple tray 581. However, the binding portion is not restricted to the lower edge, but the stapler 585 may be arranged to perform the stapling process with respect to the sheet bundle so that an upper edge of the sheet bundle is bound.

Further, the sheet post-processing device of the present invention can be expressed also as follows. A sheet post-processing device which placed sheets performs discharged from an image forming device on a post-processing tray and performs a post process with respect to the placed sheets includes: a main body having the post-processing tray; and a counter part (moving section 70) made of parts opposite to the post-processing tray, wherein the counter part is set to be able to move to the outside of the device (the device has a moving mechanism (jam-disposal mechanism 71) for moving the counter part to the outside of the device).

Further, the sheet post-processing device of the present invention can be expressed also as follows. A sheet post-processing device which places sheets discharged from an image forming device on a post-processing tray and performs a post process with respect to the sheets that have been placed on the post-processing tray, includes a moving mechanism (jam-disposal mechanism 71) for moving a tray counter part (moving section 70) opposite to the post-processing tray to a jam-disposal position, the outside of the device.

Further, the sheet post-processing device of the present invention can be expressed also as follows. A sheet post-processing device which places sheets discharged from an image forming device on a post-processing tray and performs a post process with respect to the sheets that have been placed on the post-processing tray, includes a moving mechanism for moving at least one portion of a tray counter part, opposite to the post-processing tray, to the outside of the device in a closing state. Further, the sheet post-processing device of the present invention can be expressed also as follows. A sheet post-processing device which performs a post process with respect to sheets, which were discharged from an image forming device and are placed on a post-processing tray, includes a moving mechanism for moving a tray counter part, opposite to the post-processing tray, to the outside of the device in a closing state. Note that, the closing state means a case where the tray counter part is not moved to the outside of the device (a case where the sheet post-processing device is in a normal state).

As described above, the sheet post-processing device (present sheet post-processing device) of the present invention which places sheets discharged from an image forming device on a post-processing tray and performs a post process with respect to the sheets that have been placed on the post-processing tray, includes a moving mechanism for moving a tray counter part, opposite to the post-processing tray, to the outside of the device.

The present sheet post-processing device is provided on image forming devices such as a copying machine, a printer, and a facsimile, and is to perform the post process with respect to sheets (recording papers etc.) on which images were formed. Here, the post process includes the stapling process for binding plural sheets, and a punching process for punching an edge of the sheets so as to form holes.

Further, the present post-processing device includes the post-processing tray which is used as a stand for performing the post process with respect to the sheets.

Further, particularly, the present post-processing device includes the moving mechanism for moving the portion (tray counter part), opposite to the post-processing tray, to the outside of the present image forming device.

Here, the tray counter part is a member (or a portion thereof), opposite to the sheet placing surface of the post-processing tray, and includes, for example, a transporting member for transporting sheets to the post-processing tray; a portion of the present post-processing device box body; and a transport path for discharging the sheets not via the post-processing tray.

Further, to move the tray counter part to the outside means to move the tray counter part (at least one portion thereof) from a normal position (a position of the tray counter part in a case where the present post-processing device is in a driving state (a state in which the post process can be performed), to the outside (outward) of the present post-processing device (to move the tray counter part toward the outside of the device, to move the tray counter part outward).

Further, the outside of the present post-processing device means an area exists out of the outline (outside of the outline) of the present post-processing device which is in a driving state. Note that, the present post-processing device, which is in a driving state, is in a closing state in which the tray counter part is not moved to the outside of the device.

In this way, in the present post-processing device, the tray counter part can be moved to the outside of the device, so that it is possible to form the space (jam-disposal space) by opening the front side of the post-processing tray.

Thus, in the present post-processing device, when jamming (jamming of sheets etc.) occurs in the vicinity of the post-processing tray, it is possible to remove the jamming sheets (jam disposal) so easily by using the jam-disposal space, which is formed by moving the tray counter part to the outside.

Further, the present post-processing device is arranged so that the tray counter part is moved instead of moving the post-processing tray so as to form the post-processing space. Thus, it is possible to prevent a bad influence (deterioration of the consistency etc.) given to the sheets placed on the post-processing tray. Thus, even after the jam-disposal, it is possible to perform the post process of excellent quality (workmanship).

Further, the present post-processing device is set so that the tray counter part is moved to the outside of the device so as to form the jam-disposal space. That is, the tray counter part, a portion of the device, is made to stick outward so as to change the space occupied by the tray counter part into the jam-disposal space. Thus, it is not required that the space for the jam-disposal is not provided inside the device in advance. Thus, it is easy to realize miniaturization of the device.

Note that, when the tray counter part is moved to the outside, it is not required to make the entire tray counter part stick outward. A portion of the tray counter part may stick outward as long as the sufficient jam-disposal space is formed in front of the post-processing tray.

It is preferable that the present post-processing device is provided adjacent to the image forming device so as to easily input the sheets on which images were formed. Further, in this case, it is preferable that the moving mechanism is set to move the tray counter part in a direction different from a position where the image forming device is provided.

Thus, it is possible to move the tray counter part so as to form the jam-disposal space without changing a layout of the present post-processing device and the image forming device.

Further, in the arrangement, it is preferable that the present post-processing device and the image forming device are provided so that the tray counter part is not required to exist between the post-processing tray and the image forming device. Thus, it is possible to widen moving directions of the tray counter part.

Further, it is preferable that the moving mechanism is set to move the tray counter part diagonally downward with respect to the post-processing tray. Thus, it is easy to provide other equipments (scanner etc.) above the present post-processing device (above the tray counter part).

Further, in this arrangement, it is possible to form the wide jam-disposal space by moving the tray counter part more downward than the post-processing tray, without enlarging a moving amount in a horizontal direction of the tray counter part. Further, since the moving amount in the horizontal direction of the tray counter part can be reduced, it is possible to reduce a substantial floor area occupied by the device (area occupied by the device in a case where the tray counter part is moved to the outside).

Further, in the arrangement, it is preferable that the moving mechanism includes: a locking section for fixing the tray counter part at a normal position opposite to the post-processing tray; an unlocking section for releasing the tray counter part fixed by the locking section; and a movement controlling section for controlling a position of the tray counter part between the normal position and a jam-disposal position which is set diagonally downward with respect to the normal position.

As described above, the normal position is a position of the tray counter part in a case where the present post-processing device is in a driving state (a state in which the post process can be performed). Further, the jam-disposal position is a position of the tray counter part in a case where the jam-disposal space is formed, and the position exists diagonally downward with respect to the normal position.

In the arrangement, when the jam-disposal space is formed, the unlocking section releases the tray counter part fixed by the locking section. Further, the tray counter part is set to move to the jam-disposal position, which exists diagonally downward with respect to the normal position, in accordance with the control of the movement controlling section. Thus, the tray counter part can be moved easily from the normal position to the jam-disposal position, so that it is possible to easily form the jam-disposal space.

Further, in the arrangement, it is preferable that the movement controlling section includes: a linking member has one end connected to the tray counter part and the other end connected to the main body of the sheet post-processing device, which rotates around the other end as a center so as to move the tray counter part; a stopper for controlling a rotating angle of the linking member lest that the tray counter part rotate beyond the jam-disposal position. Thus, the linking member, the locking section, and the stopper can easily control the movement of the tray counter part between the normal position and the jam-disposal position.

Further, in the arrangement, it is preferable that the tray counter part includes a portion of a side wall of the sheet post-processing device box body, and a portion of the side wall bends according to the movement of the tray counter part which moves to the jam-disposal position, and the one end of the linking member is supported rotatably by the tray counter part. Thus, it is possible to move the tray counter part from the normal position to the jam-disposal position (or in a reverse direction) with its shape kept.

Further, in the present post-processing device, the moving mechanism may be set to move the tray counter part in a substantially horizontal direction. Also in this arrangement, it is possible to easily provide other equipments above the present post-processing device.

Further, in this case, the tray counter part moves in the horizontal direction, so that it is possible to simplify a structure of the moving mechanism. That is, for example, the moving mechanism can be made up of a slide guide (slide holder) which is fixed on the main body of the device, and a slider, fixed on the tray counter part, which slides in the holder. Alternately, the moving mechanism can be made up of a rail which is fixed on the main body of the device, and a wheel, fixed on the tray counter part, which is used for gliding on the rail.

Further, in the present post-processing device, in order to make the size of the entire device smaller, it is preferable that the post-processing tray is sloped largely so that the post-processing tray (sheet placing surface) is substantially along a perpendicular direction.

However, in the arrangement, there is a case where a state of the post-processing tray cannot be seen sufficiently even though only the tray counter part is moved. Thus, in this case, it is preferable that the moving mechanism is set to move an upper part, positioned above the post-processing tray, to the outside as well as the tray counter part.

Here, the upper portion is a member (or a portion thereof), provided above the post-processing tray, and includes: for example, a transporting member for transporting the sheets to the post-processing tray; a portion of the present post-processing device box body; and a transport path for discharging the sheets not via the post-processing tray.

In the arrangement, it is possible to form the open space above the post-processing tray, so that the post-processing tray can be seen more sufficiently. Further, it is possible to form the jam-disposal space without enlarging the moving amount of the tray counter part.

Further, it is possible to look down the vicinity of the post-processing tray (place in which the jam-disposal is to be performed) from the diagonal upside, so that it is easy to perform the jam-disposal. For example, an operator can insert his/her hand from the counter part-side (front side) of the post-processing tray so as to grab the jammed sheet, and moves his/her hand upward so as to pull the jammed sheet out from the transport path.

Further, in the present post-processing device, it is preferable that the moving mechanism is set to move a beside-tray part, provided beside the post-processing tray, and the tray counter part to the outside. Here, the beside-tray part is made up of members (or a portion of each member) positioned beside the post-processing tray, such as a portion of the box body (side wall), the transporting member, and the transport path.

In the arrangement, the open space can be formed beside the post-processing tray, so that it is possible to form the wide jam-disposal space without enlarging the moving amount of the tray counter part. Further, it is possible to remove the jamming sheet from at least two directions: from the side of the counter part and from the side of the side part, so that it is easy to perform the jam-disposal process.

Further, the linking mechanism 72 of the jam-disposal mechanism 71 of the sheet post-processing device 5 may control a position of the moving section 70 between the normal position and the jam-disposal position which is set diagonally downward with respect to the normal position. The linking mechanism 72 can move the moving section 70 easily from the normal position to the jam-disposal position, so that it is possible to form the jam-disposal space easily.

Further, the sheet post-processing device can be considered to perform the staple or punching process with respect to every stack of paper, composed of a predetermined number of sheets, which is discharged from the copying machine.

Further, the technique of the document ① can be considered to be arranged so that it is possible to draw a stapling unit which has a stapler to the front side, so that disposal of jamming staples or supply of staples is performed more efficiently. Further, the following description can be considered. Since the staple unit includes also a staple tray which is used as a post-processing tray, the staple tray can be drawn to the front side, so that it is possible to operate by drawing the staple tray also in a case where the sheets are jamming.

Further, in the device, the staple unit is moved to the front side or to the back side when the jam-disposal is performed. Thus, when the tray and the unit stop, the entire sheets placed on the tray moves toward the front or back side due to inertial force. The movement of the sheets, which move to the front or back side on the tray, is restricted by a jogger which can move to the front and back sides, so that the jogger allows the sheets to move due to the inertial force of the sheets. For example, even when the sheets are adjusted again by moving the jogger after the unit is returned to the device, the consistency of the sheets deteriorates (specifically, this defect is likely to occur when the entire sheets moves).

Further, the technique of the document ② can be described as follows. When the jam-disposal is performed, a sheet guide provided above a sheet placing surface of a staple tray is moved so that an operator inserts his/her hand from the front side of the sheet post-processing device into the jam-disposal space formed in the sheet post-processing device and removes the jamming sheets. Further, since the device is arranged so that the operating space for the jam-disposal is formed only by moving the sheet guide, it is required that space, used to move the sheet guide so as to form the operating space for the jam-disposal, is provided in advance. This enlarges the size of the device.

Further, the object of the present invention can be considered to prevent the degrade of the staple quality due to the degrade of the consistency of the sheets on the staple tray which are brought about by the movement of the staple tray in performing the jam-disposal, and to prevent the enlargement of the device which are brought about by providing space for forming the jam-disposal space in advance.

Further, FIG. 2 is a longitudinal section of the digital complex machine 1, and the digital complex machine 1 can be described as follows. In the digital complex machine 1, a scanner section 3, a sheet post-processing device 5, a multistage sheet feeding unit 6, a relay transporting unit 8, and a double surfaces copying unit 10 are connected to a print section 2 as a core, so that functions are expanded. Further, the scanner section 3 is supported by a system rack 7 so as to be provided on the sheet post-processing device 5 on the print section 2.

Further, when a record-output of an image read by the scanner section 3 is inputted to the print section 2, or an image forming device such as a personal computer is connected to the print section 2, the print section 2 record-outputs image data inputted from the outside equipments. In the print section 2, an electrophotograph process section 28, in which a photosensitive drum 21 is centered, is provided on the right side of the substantial center of the main body of the device.

Further, a sheet receiving opening 27 is provided on the underside of a main body of the print section 2. The sheet receiving opening 27 receives sheets transported from the multistage sheet feeding unit 6 etc. provided as peripheral equipments, and inserts the sheets successively into a gap between the photosensitive drum 21 and the transcribing unit.

Further, the fixer 41 is provided above the electrophotograph process section 28, and successively receives the sheets on which images were transcribed, and heats and fixes developer agent transcribed on the sheets, and transports the sheets to the outside of the fixer 41. Note that, the sheets on which images were recorded are transported from the discharging roller 43 to the relay transporting unit 8 provided on the print section 2.

Further, the print controlling section 24, the image controlling section 25, and the power unit 26 can be described as follows. They are provided upward and downward with respect to the LSU 27. Further, the image controlling section 25 can be described as follows. The image controlling section 25 performs a predetermined image process with respect to image data received from an interface substrate, and includes an image controlling unit (ICU) substrate for making the LSU 27 record the data image as an image by scanning.

Further, the multistage sheet feeding unit 6 can be described as follows. The multistage sheet feeding unit 6 is arranged so that the sheet post-processing device 5 and the print section 2 are provided successively on the multistage sheet feeding unit 6, and the moving rollers 69 and the fixing sections 68 are provided on an underside of the multistage sheet feeding unit 6 so that it is possible to provide the multistage sheet feeding unit 6 in the system rack 7. When the multistage sheet feeding unit 6 is to be moved, the fixing section 68 is lifted away from a floor by rotating the fixing section 68. When the multistage sheet feeding unit 6 is to be fixed, the fixing section 68 is lowered by rotating the fixing section 68 so as to touch the floor.

Further, in the present embodiment, the multistage sheet feeding unit 6 includes three sheet providing sections 61, 62, and 63. It is preferable that the digital complex machine 1 is arranged so that, as well as the sheet feeding cassette 22, plural sheet providing sections which store sheets of the same size are provided on the digital complex machine 1.

Further, the sheet post-processing device 5 introduces the sheets, which images were recorded on and discharged from the relay transporting unit 8 or the print section 2, by feed-in roller 50, and performs the post process (stapling process) with respect to the sheets.

Further, the relay transporting unit 8 and the sheet post-processing device 5 can be described as follows. The relay transporting unit 8 is a transporting unit provided above the discharge tray 44 provided on a top part of the print section 2, and the sheet post-processing device 5 is provided on the downstream side with respect to the print section 2.

Further, the first and second transport path 83 and 84 can be described as follows. The first transport path 83, which leads the sheet to the discharge tray 85 made up of a top face of the relay transporting unit 8 and a top face of the sheet post-processing device 5, is taken from the second transport path 84. Further, the switching gate 81 is provided on the junction of the first and second transport path 83 and 84.

Further, the discharge tray 85 is also used as a reverse transport path of the sheet, and the discharge tray 85 and the double surfaces copying unit 10 forms images on both surfaces of the sheet.

Further, in the transport path (transport section 23) which is formed from the sheet feeding cassette 22, and sheet providing sections 61, 62, 63 to the electrophotograph process section 28 and the fixing device 41, the gate 45 is provided on the downstream side with respect to the fixing device.

Further, when the switching gate 45 is switched in a direction shown by the continuous line of FIG. 1, the fixed sheet is discharged to the sheet post-processing device 5 or the discharge tray 85. Further, when the discharge tray 85 is used as the reverse transport path, the sheet is pulled back, and is reverse-transported via the switching gate 45, which was switched in a direction shown by a broken line, to the double surfaces copying unit 10.

Further, in the sheet post-processing device 5, when a sensor (not shown) judges that a thickness of the sheet bundle is thinner than a predetermined thickness, or when a counter (not shown) which counts the number of the sheets judges that the sheet bundle has less sheets than a predetermined number, the sheets may be inserted into the discharging roller 587 so as to be discharged to the discharge tray 59 at a lower stage. While, when the sensor judges that the thickness of the sheet bundle is thicker than the predetermined thickness, or when a counter judges that the sheet bundle has more sheets than the predetermined number, a controlling section (not shown) may make the solenoid 589 ON. Thus, the upper roller of the discharging roller 587 is lifted. After the sheet is transported by the roller/belt pair transport section 583 to a position where the sheet is inserted into the discharging roller 587, the controlling section makes the solenoid OFF. Thereafter, the sheet inserted into the discharging roller 587 is discharged to the discharge tray at the lower stage.

Further, the switching gate 52 of the sheet post-processing device 5 is switched by selecting the first transport path 53 on which the stapling process is not performed, or the second transport path 54 connected to the stapling process section, in accordance with modes specified by the user. Further, the sheet which was introduced into the first transport path 53 by switching the switching gate 52 is discharged to the discharge tray at an upper stage by the first discharging roller 55 without performing any process with respect to the sheet. While, the sheet which was introduced into the second transport path 54 by switching the switching gate 52 is led to the stapling processing section 58 by the second discharging roller 57 provided on the transport path 54. Further, the adjusting plate 582 can be described as follows. The adjusting plate 582 is to adjusts the sheets in a direction orthogonal to a transporting direction.

Further, the sheet post-processing device 5 can be described as follows. According to the sheet post-processing device 5, as shown in FIG. 4 and FIG. 5, in the second transport path 54 which does not have the switching gate 52, it is possible to move the sheet transport section (moving section), which is provided opposite to the sheet placing surface of the staple tray 581, away from the sheet placing surface of the staple tray 581, in an inclining direction (diagonally downward) of the staple tray 581.

Further, the linking mechanism can be described as follows. The linking mechanism is provided between the body of the sheet post-processing device 5 and the moving section 70. Further, a stopper 592, provided in the vicinity of a position where the lower end 76*b* of the linking member 76 is supported by the body frame, stops the anti-clockwise rotation of the linking member 76 shown in FIG. 6.

Further, the jam-disposal mechanism 71 may be arranged so that when the unlocking lever 77 provided on the top part 70*a* of the moving section 70 is held by hand, the hook member 78, which is provided on the rotating axis 77*a* of the unlocking lever 77 so as to make up one body, rotates clockwise as shown in FIG. 6 around the rotating axis 77*a* as a center so as to be released from the pin 79. Further, in this state, when the moving section 70 is led diagonally down to the left by hand, the moving section 70 moves with its shape almost kept, and the open space is formed above the sheet placing surface. Thus, it is possible to form the jam-disposal space.

Further, an energizing member for energizing the hook member 78 anti-clockwise in FIG. 6, may be provided between an end of the rotating axis 77*a* and the frame of the moving section 70. In this way, the moving section 70 is moved right upward by hand so as to return the moving section 70, and when the moving section 70 is completely returned, the hook member 78 is hooked to the pin 79, so that the moving section 70 is hooked to the sheet post-processing device 5.

Further, according to the arrangement in which the moving section 70 is moved in a horizontal direction, the moving section and the main body of the device are connected to each other via the first slide guide 94 and the second slide guide 95 on the back side (back side of FIG. 8), and they may be connected to each other via the third slide guide (not shown), which is positioned as high as the second slide guide 95, on the front side (front side of FIG. 8). Also in this arrangement, it is possible to perform the jam-disposal by moving the moving section 70 without impairing the efficiency of an operation of the scanner section 3 which is provided above the sheet post-processing device 5.

Further, the moving section 70 may be used as a sheet transport section which is provided opposite to the sheet placing surface of the staple tray 581. Further, besides these portions, it is also possible to make an arrangement so that a front side of the sheet post-processing device 5 is opened at the same time. Thus, it is possible to look down the jam-disposal space from the diagonal upside, so that it is easy to perform the jam-disposal. That is, since the jamming sheet can be grabbed not only from the upside but also from the side, it is possible to obtain such effect that the jamming sheet can be pulled out easily.

Further, in the sheet post-processing device 5, since the moving section 70 moves in an inclining direction of the staple tray, it is possible to form the wide jam-disposal space above the sheet placing surface even though the moving section 70 does not move largely in a horizontal direction.

Thus, it is possible to easily remove both the jamming sheet which exists on the staple tray and the jamming sheet which exists in the transport path. Further, it is possible to reduce a substantial floor area occupied by the device. Further, it is possible to form a space having the same length as that of the staple tray. Further, since the switching gate 52 is arranged to remain in the body instead of moving with the moving section 70, the switching gate 52 does not exist on the side of the jam-disposal space when the moving section moves so as to form the jam-disposal space, so that the switching gate 52 does not prevent the jam-disposal.

Further, the present invention can be expressed as the following first to seventh sheet post-processing devices. That is, the first sheet post-processing device stacks sheets discharged from an image forming device on the post-processing tray and performs the post process (a stapling process, a punching process, and a sizing/binding process etc.) with respect to the stacked sheets. Thereafter, in the sheet post-processing device which discharges the sheets which has been subjected to the post process, the sheet transport section, provided opposite to the sheet placing surface, is moved away from the sheet placing surface of the post-processing tray so as to form the jam-disposal space in the vicinity of the sheet placing surface of the post-processing tray.

In the arrangement, the post-processing tray is not moved after performing the jam-disposal, so that it is possible to prevent the deterioration of the consistency of the sheets on the post-processing tray which brought about by the movement of the post-processing tray. Thus, it is possible to prevent the deterioration of the quality of the post process such as the stapling process. Further, in the arrangement, since the jam-disposal space is formed by moving the sheet transport section which is provided opposite to the sheet placing surface of the post-processing tray, it is not required that a space is provided in advance so as to form the operating space for performing the jam-disposal, so that it is possible to realize the miniaturization of the device.

Further, the second sheet post-processing device is different from the first sheet post-processing device in that the sheet placing surface of the post-processing tray faces a side of the discharge tray, and the sheet transport section, which is provided opposite to the sheet placing surface of the post-processing tray, is provided closer to a discharging direction of the sheet than to the sheet placing surface of the post-processing tray, and the sheet transport section moves with respect to the main body.

When the post-processing tray is provided so that the sheet placing surface of the post-processing tray faces a feed-in side (for example, a side of the feed-in roller) of the sheet post-processing device provided in the vicinity of the main body of the image forming device, the sheet transport section which is provided opposite to the sheet placing surface of the post-processing tray becomes a transport section on the side of the feed-in roller.

In this case, when the transport section on the side of the feed-in roller is arranged to move, it is required that the main body of the sheet post-processing device is moved away from the main body of the image forming device before moving the transport section on the side of the feed-in roller. Thus, more operations are required so as to perform the jam-disposal, and the quality of the operations deteriorates since the large main body of the sheet post-processing device is moved.

Further, in this case, when the transport section on the side of the feed-in roller is arranged to move upward, a space, from which the transport section on the side of the feed-in roller moved, becomes a space to perform the jam-disposal, the jam-disposal is performed from the underside of the device with the operator keeping an uncomfortable position. Thus, the quality of operations deteriorates, or it is required to enlarge the moving amount of the transport section on the side of the feed-in roller, so that the moving mechanism becomes complicated and the size thereof becomes enlarged.

On the other hand, in the second sheet post-processing device, the sheet placing surface faces a side of the discharge tray, so that it is possible to move the sheet transport section provided opposite to the sheet placing surface by a simple moving mechanism. Thus it becomes easier to perform the jam-disposal.

Further, the third sheet post-processing device is different from the first sheet post-processing device in that when other devices are provided above the sheet post-processing device, the sheet transport section, provided opposite to the sheet placing surface of the post-processing tray, moves in a substantially horizontal direction or diagonally downward.

In the arrangement, the sheet transport section, provided opposite to the sheet placing surface of the post-processing tray, is not moved upward. Thus, even though other devices (scanner etc.) are provided above the sheet post-processing device, operations of other devices which are provided above the sheet post-processing device are not prevented. Further, by the arrangement, it is possible to form a sufficient space in which the sheet transport section provided opposite to the sheet placing surface can move, so that the wide jam-disposal space can be formed.

Further, the fourth sheet post-processing device is different from the first sheet post-processing device in that the sheet transport section, provided opposite to the sheet placing surface of the post-processing tray, moves diagonally downward.

In the arrangement, the sheet transport section, provided opposite to the sheet placing surface of the post-processing tray, moves in an inclining direction of the post-processing tray. Thus, even though the moving amount in a horizontal direction is not large, it is possible to form the wide jam-disposal space above the post-processing tray. Thus, it is easy to perform the jam-disposal both on the post-processing tray and on the transport path.

Further, since the sheet transport section moves in the inclining direction of the post-processing tray, it is possible to form a space, having the same length as the post-processing tray, in which the sheet transport section can move. Further, the moving amount of the sheet transport section which is provided opposite to the sheet placing surface of the post-processing tray is small, so that it is possible to reduce a substantial floor area occupied by the device (area occupied by the device in performing the jam-disposal etc). Further, when seen from a discharging direction, there exists a gap between the sheet transport section and the feed-in roller. Thus, it is easy to perform the jam-disposal in the vicinity of the feed-in roller.

Further, the fifth sheet post-processing device is different from the first sheet post-processing device in that a side face on the upside of the post-processing tray and the side face of the post-processing tray on the front side of the post-processing device are opened at the same time by moving the sheet transport section which is provided opposite to the sheet placing surface of the post-processing tray.

In this arrangement, it is possible to look down a portion on which the jam-disposal should be performed from a diagonal upside, so that it is easy to perform the jam-disposal. And it is possible to remove the jamming sheet from two directions: from the front side and from the upside. For example, an operator inserts his/her hand from the front side so as to grab the jamming sheet, and pulls the jamming sheet upward. Thus, it is easy to perform the jam-disposal.

Further, the sixth sheet post-processing device is different from the first sheet post-processing device in that in a case where the sheet transport section, provided opposite to the sheet placing surface of the post-processing tray, moves with a component of a horizontal direction included, a lower edge of sheets are bound on the post-processing tray and the bounded sheets are discharged, and the sheet transport section, opposite to the sheet placing surface of the post-processing tray, is positioned closer to the feed-in roller.

In the arrangement, the moving amount of the sheet transport section, provided opposite to the sheet placing surface of the post-processing tray, is small, so that it is possible to reduce a substantial floor area occupied by the device (area occupied by the device in performing the jam-disposal etc).

Further, the seventh sheet post-processing device is different from the first sheet post-processing device in that when the sheet transport section is moved, gate means remains on the side of the main body of the device. Since the gate means and the sheet transport section do not move, the gate means is positioned on the side of the main body of the device. Thus, it is possible to prevent the efficiency of the jam-disposal from being deteriorated.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. A sheet post-processing device which places sheets, discharged from an image forming device, on a post-processing tray and performs a post process with respect to the sheets that have been placed on the post-processing tray, comprising:

a moving mechanism for moving a tray counter part, provided opposite to a face of the post-processing tray onto which face the sheets discharged from the image forming device are placed, to an outside of the sheet post-processing device without moving the post-processing tray, wherein said moving mechanism is set to move the tray counter part in a substantially horizontal direction, and the moving mechanism moves the tray counter part away from the post-processing tray to expose the post-processing tray.

2. The sheet post-processing device set forth in claim 1, wherein:

said post-processing tray is provided substantially along a perpendicular direction, and an upper part positioned above the post-processing tray is connected to the tray counter part, and said moving mechanism is set to move the upper part and the tray counter part.

3. The sheet post-processing device as set forth in claim 1, wherein the direction in which said moving mechanism moves the tray counter part is different from a direction in which the image forming device is provided.

4. The sheet post-processing device as set forth in claim 1, wherein said post-processing tray is provided substantially along a perpendicular direction, and an upper part positioned above the post-processing tray is connected to the tray counter part, and said moving mechanism is further set to move the upper part.

5. The sheet post-processing device as set forth in claim 1, wherein:

said post-processing tray is provided substantially along a perpendicular direction, and said moving mechanism is set to move an upper part positioned above the post-processing tray, and the tray counter part, outside of sheet post-processing device.

6. The sheet post-processing device as set forth in claim 5, further comprising a discharging member for discharging a sheet bundle, which has been subjected to the post-process, from a bottom side of the post-processing tray to the outside.

7. The sheet post-processing device as set forth in claim 6, further comprising a stapler for performing a stapling process with respect to a lower edge of the sheets placed on the post-processing tray.

8. The sheet post-processing device as set forth in claim 1, wherein said moving mechanism is set to move a beside-tray part positioned beside the post-processing tray, and the tray counter part, to an outside of the post-processing device.

9. The sheet post-processing device as set forth in claim 1, further comprising an upper part positioned above the post-processing tray and connected to tray counter part, wherein a sheet feeding path for guiding sheets to be discharged from the image forming device is provided by the upper part.

10. The sheet post-processing device set forth in claim 1, wherein:

the moving mechanism, tray counter part and post-processing tray are structured and configured such that the moving mechanism is operable to move the tray counter part away from the post-processing tray to expose the post-processing tray.

11. The sheet post-processing device set forth in claim 1, wherein:

the sheet-post processing device comprises a sheet discharge tray operatively coupled to the tray counter part, and the moving mechanism is constructed to move the tray counter part together with the sheet discharge tray to the outside of the sheet post-processing device to expose the post-processing tray.

12. A sheet post-processing device which places sheets, discharged from an image forming device, on a post-processing tray and performs a post process with respect to the sheets that have been placed on the post-processing tray, comprising:

a moving mechanism for moving a tray counter part, provided opposite to the post-processing tray, to an outside of the sheet post-processing device without moving the post-processing tray, wherein said moving mechanism is set to move the tray counter part in a substantially horizontal direction, and said moving mechanism includes:

a slide holder fixed on a main body of the sheet post-processing device; and a slider, fixed on the tray counter part, which slides in the slide holder.

* * * * *